US006095565A

United States Patent [19]

Kramer

[11] Patent Number: 6,095,565

[45] Date of Patent: Aug. 1, 2000

[54] BOOKMARK AND POCKET ASSEMBLY FOR BOOKS

[76] Inventor: Robert Kramer, 5885 Allison Ave., Arvada, Colo. 80001

[21] Appl. No.: 09/131,708

[22] Filed: Aug. 10, 1998

[51] Int. Cl.[7] ..... B42D 9/00

[52] U.S. Cl. ..... 281/42; 40/124.1; 116/235; 116/238; 116/239; 281/15.1; 281/21.1; 281/31; 281/51

[58] Field of Search ..... 116/234, 235, 116/238, 239, 240; 281/15.1, 21.1, 31, 42, 51; 40/124.1

[56] References Cited

U.S. PATENT DOCUMENTS

| | | | |
|---|---|---|---|
| 670,766 | 3/1901 | Carelton | 116/309 |
| 2,590,615 | 3/1952 | Heckendorn | 116/234 |
| 2,633,372 | 3/1953 | Wilson | 281/42 |
| 4,643,301 | 2/1987 | Hehn et al. | 206/232 |
| 4,696,490 | 9/1987 | Sendor | 281/15 |
| 5,359,793 | 11/1994 | Copperstone | 40/124.1 |
| 5,382,053 | 1/1995 | Tanaka | 281/42 |
| 5,427,640 | 6/1995 | Daniels | 156/250 |
| 5,503,102 | 4/1996 | McDonnell | 116/238 |
| 5,638,953 | 6/1997 | House | 206/308 |
| 5,713,606 | 2/1998 | Kleinberg et al. | 281/42 |
| 6,000,724 | 12/1999 | Holway | 281/31 |

*Primary Examiner*—Andrea L. Pitts
*Assistant Examiner*—Monica Smith Carter

[57] ABSTRACT

A bookmark and pocket assembly for books, where a pocket allows a bookmark to be releasbly secured to the book by slidably inserting it into the pocket. The assembly is generally rectangular in shape and has the bookmark detachably joined on one side to the pocket by a bookmark tear line, and a binding panel detachably joined on another side by a binding tear line. The bookmark has an area defined for an advertisement or aesthetic design and the pocket has a front panel foldably joined to a rear panel. The front panel has an adhesive pattern so that when the rear panel is folded on to the front panel, a recess is formed in generally the same shape and size of the bookmark. The rear panel has a rear adhesive pattern on a back surface for attachment to a book surface and a backing sheet covering the adhesive over its extremities. The binding panel serves and an interface for binding the assembly as an insert to a spine of the book, where the book will then be shipped for resale. The insert is detachable from the book by pulling it along the binding tear line. The bookmark is then detached from the pocket, and the backing sheet is removed from the adhesive. The rear surface of the pocket is then affixed surface on book, and the bookmark is inserted into the recess of the pocket.

19 Claims, 8 Drawing Sheets

BOOKMARK AND POCKET ASSEMBLY FOR BOOKS

BACKGROUND OF THE INVENTION

1. Field of the Invention

The present invention relates to bookmarks, and more particularly, a bookmark and pocket insert assembly that can be used as a source of advertisement for a book, magazine, catalog or like publication in which a plurality of pages are secured at the spine edges of the pages.

2. Description of the Prior Art

It is not uncommon for a person reading a book to mark a place for reference or to return to in the future to continue reading that publication. This is typically done by locating a bookmark or like object such as a piece of paper and inserting it between the desired pages of the book. The difficulty in this method is that the piece of paper or bookmark is often not available to the reader or in the vicinity of the book when needed. If a bookmark or like object is not found, another common technique is to fold over a corner of one of the pages to act as a mark. This approach is ineffective in that the turned over corners become inconspicuous after the book is closed and therefore difficult to find.

In addition to not having a universally accepted form of marking pages, books are generally not accepted as a medium used for advertising. The majority of current day advertising is conducted on mediums such as magazines, newspapers, radio, television, etc. These mediums allow for only a short period of time in which the consumer is exposed to the ad. Therefore, the advertisers spend a great deal of effort and money attempting to get their message across to the consumer. Conversely, a typical book has several hours of exposure that can aid in anchoring in the message of the advertiser.

The most common method for advertising in magazines is to bind the advertisement as a permanent leaf or like page in the publication. Books have traditionally been exempt from this form of advertising. This is due largely in fact that page-by-page advertising would be distracting to the reader and would significantly decrease the value of the book. In fact, any advertisement that is permanently associated to the book has the ability to devalue the book. Unlike magazines, publishers of books generate the majority of their revenue from the sale value of the published item. Therefore, the placement of an ad that devalues the book in any way would be restricted, as it would result in a loss of revenues. It would consequently be of considerable value to have a bookmark that is simple to manufacture for advertising and is conveniently secured so that it can be reattached to the book as well as removed if deemed undesirable by the reader.

One such method would be the use of a pocket to store the bookmark. There have been many books provided with prior art in the form of pockets structurally incorporated in the book for receiving supplements to the book. These supplements are often planar articles that the user of the book will periodically remove for reference. For example, the pocket may be used to store a map, a reference chart, or the like that relates to the subject matter of the book and that for convenience must be separable from the book. U.S. Pat. No. 4,696,490 describes a pocket assembly for retaining numerous or large supplements. U.S. Pat. Nos. 5,638,953 and 5,694,743 describe applications that provide pocket or attachment capability for a compact disk and or computer disk.

There have also been many forms of prior art that permanently attach to the book. They are often in the form of ribbons, twine, paper or the like that is adhered to the book and can be extended or moved to be placed between pages. An example of this would be U.S. Pat. No. 2,633,372, which describes a bookmark that retracts from the inner face of the back of a book. The bookmark is attached to the book with an anchor strip and cannot be removed from the book without damaging the anchor strip. U.S. Pat. No. 5,503,102 describes a shape-retaining bookmark that can be received in a pocket. However, this bookmark is adhered in the pocket and not meant to detach from the book once installed.

There are also several forms of prior art that attach through means of clipping to either the spine, leaves, or cover of the book. In this regard, reference may be made to U.S. Pat. Nos. 1,808,931, 2,591,094, 4,574,727 and 4,838,198. These examples of prior art are expensive to manufacture and none indicate or have provisions for an advertisement.

U.S. Pat. No. 5,713,606 does incorporate a bookmark that is bound as a leaf in a book or more specifically a trade journal or magazine. This example of prior art is an improvement over the above listed in that it does provide a method for advertising. The bookmark is perforated from the page so that it can be detached from the book and used accordingly. However, once the mark is torn from the book, there is no place for the mark to be secured to the book while the user is reading or when stowed after completion of the book. The mark is therefore apt to be misplaced or lost. Since the bookmark is no longer an integral part of the book once it is detached, it does not add value to the book and the purchaser of the book is not likely to pay more for it than a book without one. Since no additional revenue is received from the sale of the book with this item, the majority, if not all, of the profit generated from the advertisement itself is likely to be consumed from the manufacture and installation of the bookmark.

With the foregoing deficiencies in mind, it is an object of this invention to provide a bookmark and pocket assembly that is convenient and available to the reader whenever the book is opened. With the bookmark of the present invention, there is no need for the reader to search for a bookmark or like object. With use of the pocket, the bookmark is assured to be with the book when the reader needs it. The bookmark of the present invention also eliminates the need to turn over the comer of pages if a bookmark or like object is not found.

Another object of the present invention is to provide a bookmark and pocket assembly that, in addition to functioning as a bookmark, serves as a new and efficient method for advertising. The bookmark has ample surface area to serve as a simple and effective medium to display an advertiser's message, which the consumer will be exposed to the every time they pick up or mark a page in the book.

A further object of the present invention is to provide a bookmark and pocket assembly that is inexpensive to manufacture and simple to install into the book in an automated fashion. A significant aspect of the present invention is that it combines different operation or process components in a manner in which automated machinery or systems can be readily adapted and used to produce and install the present invention. Further, the present invention enables each of the various component processes to be accomplished in an independent manner, allowing for a shorter production time.

A further object of the present invention is to provide a bookmark and pocket assembly where the bookmark is a separate retractable entity that can be removed or returned to a secured location in the book. While reading the book, the user can return the bookmark to the pocket where it is inconspicuous and out of the way. Therefore, the bookmark doesn't distract the reader from the material as they are moving along the book. Because of its inconspicuous placement, the advertisement will not deface or devalue the book. If the reader still deems the bookmark undesirable, they can simply discard it and replace it with another of similar size and shape. In fact, this form of advertisement adds value to the book in that it gives the reader a convenient bookmark and pocket that eliminates the need to place the mark before or aft of the present page or beside the book where it can be misplaced. The pocket also provides a way to store the bookmark in the book for shelving after the user has completed reading the book. This added value can be used to adjust up the price of the book, relieving the need for advertising to fund the cost of implementing the present invention.

SUMMARY

The present invention provides a bookmark and pocket assembly having a bookmark insertable into a pocket, retainer, receptacle, or sleeve, which is in turn bound or attached into a book either during or after the manufacturing process. There are numerous embodiments that can accomplish the objectives of the present invention. For clarity, these embodiments will be subcategorized into two main embodiments.

The first main embodiment pertains to attaching the bookmark and pocket assembly through binding it as a page in a book. The second main embodiment involves attaching the bookmark assembly to the cover of the book. Both of these main embodiments have numerous variations that will be described in detail in the following section.

BRIEF DESCRIPTION OF THE DRAWINGS

The above and other objects and advantages and novel features of the present invention will become apparent from the following detailed description of the invention illustrated in the accompanying drawings, in which.

DETAILED DESCRIPTION OF THE PREFERRED EMBODIMENTS

1. First Main Embodiment: Bound Insert

Figure 1A:
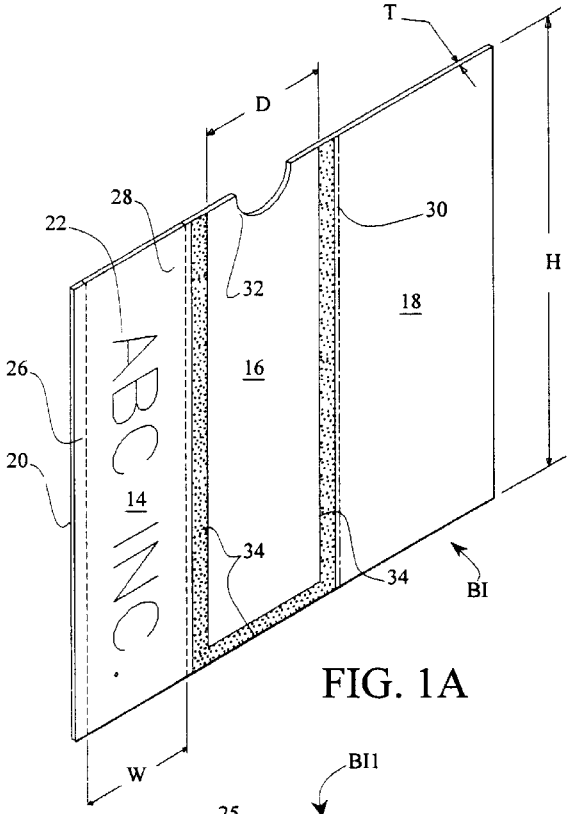
FIG 1A is a front perspective view illustrating a paperboard insert from which the bookmark and pocket insert may be formed.
Figure 1B:
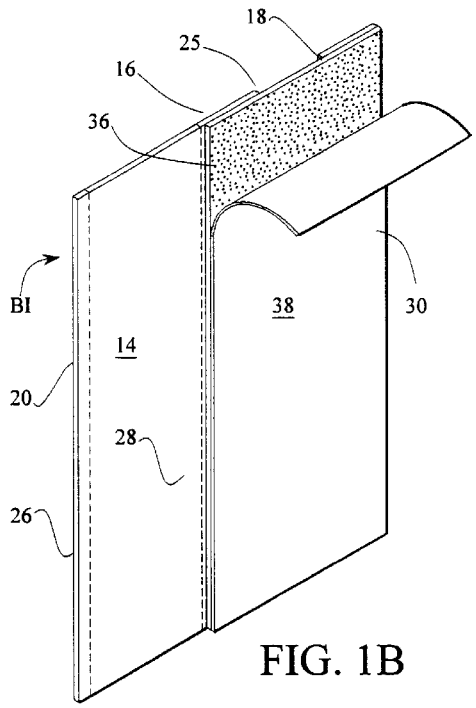
FIG 1B is a view similar to that of FIG 1A, but illustrating a folded configuration with the adhesive backing partially applied.

An embodiment of the present invention can be seen in FIG. 1A and FIG. 1B. FIG. 1A is a rear perspective view of a binding insert pocket BI that consists of foldable sheet material, including, but not limited to, paper or paperboard. The binding insert pocket BI is preferably, but-not necessarily, rectangular in shape and has a front panel 16, a rear panel 18, a binding panel 20, and a bookmark sheet 14. The bookmark sheet 14 is separated from the front and binding panels 16 and 20 by two perforation lines, a binding tear line 26, and a bookmark tear line 28. The front panel 16 has a "U" shaped, front adhesive pattern 34. The adhesive pattern 34 is preferably a pressure or heat sensitive adhesive and forms a thin strip around the vertical and bottom edges of the front panel 16. The distance D of the inner boundaries of the adhesive pattern 34 is greater than the width of the bookmark W. As the thickness T of the binding insert BI increases, the greater the amount that D will exceed W. The binding insert BI has a height H that is approximately three times longer than the width W. The front panel 16 has a thumb notch 32 that facilitates the easy removal of the bookmark sheet 14 when it is in its stowed position. The thumb notch 32 is illustrated as a half-circle type cut-out, but may consist of any shape or size that is desirable, such as a rectangle, triangle, etc. The binding insert BI can have a message, picture or advertisement 22 printed on the bookmark sheet 14 and or the front panel 16.

A fold line 30 that runs vertically down the right side of the adhesive pattern 34 separates the rear panel 18 from the front panel 16. The fold line 30 is preferably a score in the sheet material. However, the fold line 30 may be formed by any desirable method such as a perforation, crease in the sheet material, or the like. FIG. 1B illustrates the rear panel 18 folded 180 degrees about the fold line 30. This operation bonds the front panel 16 and the rear panel 18 together and forms a pocket 24 with a recess 25. The exposed side of the rear panel 18 has a rear adhesive pattern 36 and a peel-off backing sheet 38 that is shown partially applied in FIG. 1B. The adhesive pattern 36 and backing sheet 38 may be applied before or after the rear panel 16 has been folded over. The backing sheet 38 is preferably covered by a release material such as silicone, so that it may be easily removed from the adhesive pattern 36.

It is important to note that the invention is not intended to be limited to the type of adhesive used or by the location or shape of the front adhesive pattern 34 of rear adhesive pattern 36. For example, the U-shaped adhesive 34 may be applied as an "L" shape, and could be apppalied to the rear panel 18 instead of the front panel 16. As well, the rear adhesive pattern 36 may consist of a moisture-sensitive adhesive instead of the backing sheet 38. In this case, the user would apply moisture to the adhesive 36 and adhere the pocket 24 to the desired location on the book B. The thickness of the binding insert BI may also vary depending on the folding capabilities of the machinery being used or the desired flexibility of the bookmark sheet 14.

The advantage of the bookmark and pocket assembly of the present invention is that it can be manufactured and assembled in a completely automated fashion using the machinery and processes of the current industry. The binding insert can be cut, printed, perforated, folded, applied with adhesive and backing sheet, all in an assembly line fashion much the same way envelopes and boxes are currently produced in large volume. This high volume, fast approach significantly reduces the cost of manufacturing the insert. As well, the whole process can be done independently with the production of the book lending to a quicker time-to-market.

Once the binding insert BI is completed, it can the then be bound in the book by using the same methods and machinery used by bindery companies to bind the signatures of pages into books. The binding process, of which the details are not shown, first involves the folding of large sheets of printed paper several times into signatures until the actual book page size is achieved. In the perfect binding process, the signatures are then gathered in their folded state, ground down at the binding edge and glued together. For books that are case bound, the signatures are gathered and then sewn together at the binding edge. In both cases, the blocks of signatures are then cut at the three remaining edges to produce an even, flush series of pages.

Figure 2A:
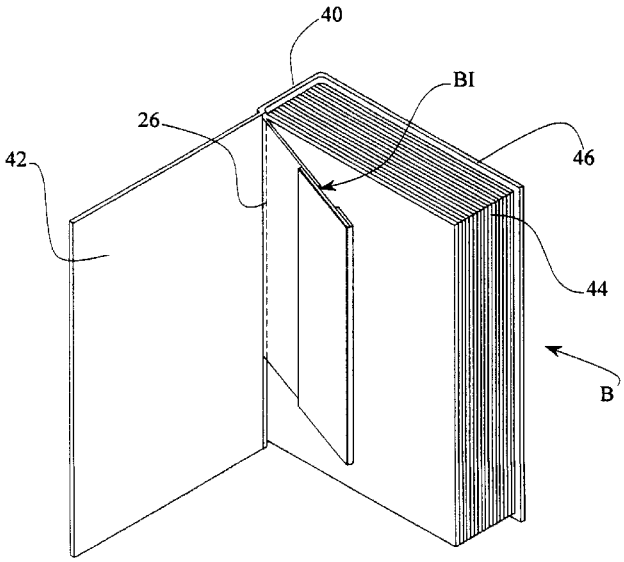
FIG. 2A is a front perspective view of a publication such as a book, shown partly open, illustrating the bookmark and pocket insert bound as an page in the book.

Without any significant change in the machinery, the binding inserts BI are gathered and bound into a spine 40 of book B along with pages 44, as illustrated in FIG. 2A. The binding insert BI is bound at either the front cover panel 42, rear cover panel 46, or between signatures of pages 44. The binding insert BI may be installed at the top or bottom edges of the pages 44, in which it will be cut flush with the other pages in the trimming process. It can also be inserted midway between the top and bottom edges of the pages 44 to avoid being trimmed. The book is then completed with the finishing processes in its normal manner.

Figure 2B:
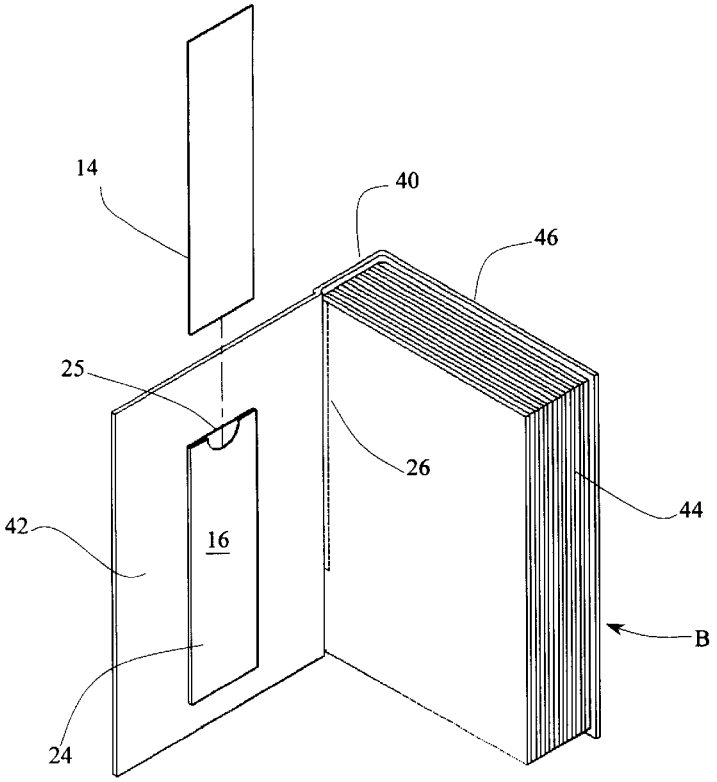
FIG. 2B is an exploded view illustrating the pocket installed to the inside cover of the book and the bookmark in line with the pocket.
Figure 2C:
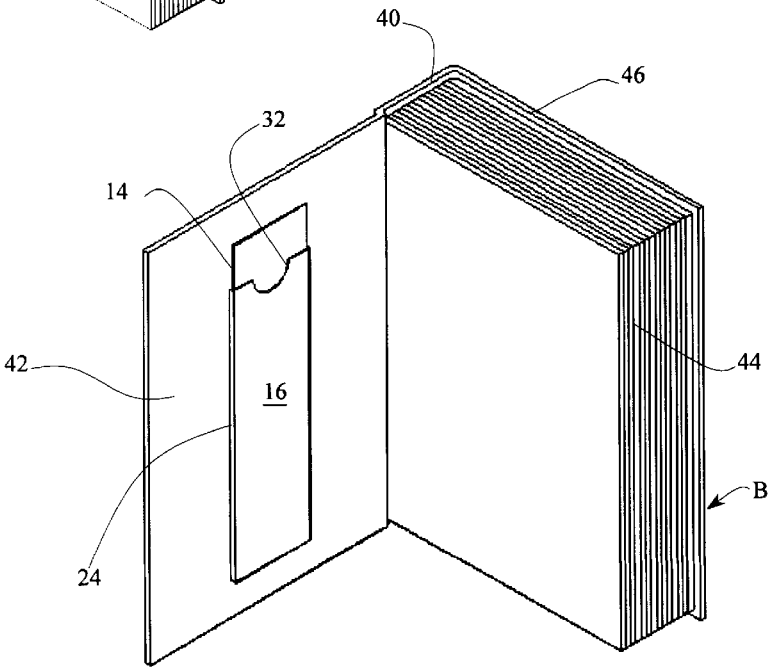
FIG. 2C is a view similar to FIG. 2B, but illustrating the bookmark inserted in its stowed position in the pocket.

Once the consumer receives the book in the configuration illustrated in FIG. 2A, she removes the bookmark and pocket assembly from the book by pulling along the binding tear line 26. The bookmark sheet 14 can then be separated from the pocket 24 by pulling along the bookmark tear line 28. The peel-off backing sheet 38 is then removed from the back of the pocket 24 and can be attached and adhered about the book at the user's discretion. FIG. 2B illustrates an exploded perspective view of the pocket 24 adhered to the inside of the cover panel 42 of the book B. The bookmark sheet 14 can then be inserted between the front panel 16 and rear panel 18 into its stowed position in the pocket 24, as illustrated in FIG. 2C. When the reader needs the bookmark sheet 14 to mark a page, he would press on the exposed part of the bookmark at the thumb notch 32 and pull the bookmark up and out of the pocket. He is then free to place the bookmark between the pages he desires to mark.

Figure 1C:
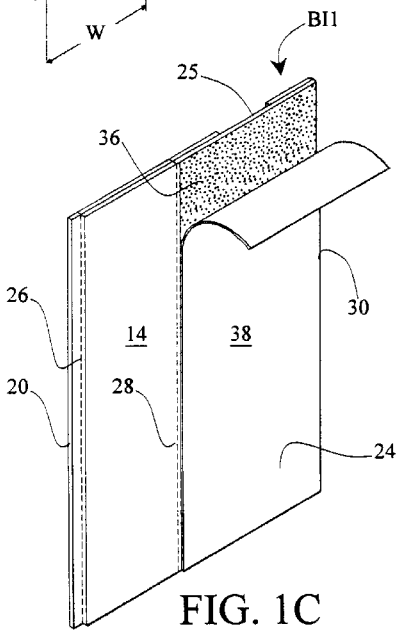
FIG 1C is a view similar to that of FIG. 1B, but illustrating a slightly modified embodiment to create a 2-ply bookmark.

Additional embodiments of the binding insert BI are shown in FIGS. 1C, 3A, 3B, 4A, 4B, 5 and 6A–C. In FIG. 1C a binding insert BI1 has a 2-ply laminated bookmark sheet 14. This configuration is achieved by lengthening the rear panel 18 so that when folded it extends along the width W of the bookmark sheet 14 at the binding tear line 26. The adhesive pattern 34 would also be extended across the bookmark sheet 14 to the binding tear line 26. Both sheets would then be perforated at the binding tear line 28. This embodiment would allow the bookmark 14 to be twice as thick and rigid without having to increase the stock size of the binding insert BI1. Another benefit of embodiment BI1 is that it has a more uniform thickness across its length. Therefore, it stacks more evenly when gathered in large numbers.

Figure 3A:
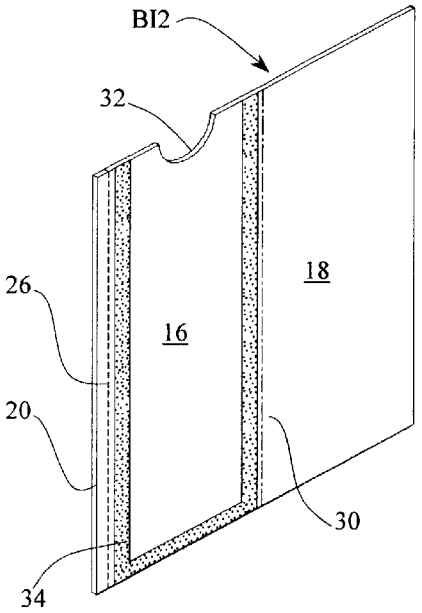
FIGS. 3A and 3B illustrate an insert similar to seen in FIGS 1A and 1B, but without a perforated bookmark.
Figure 3B:
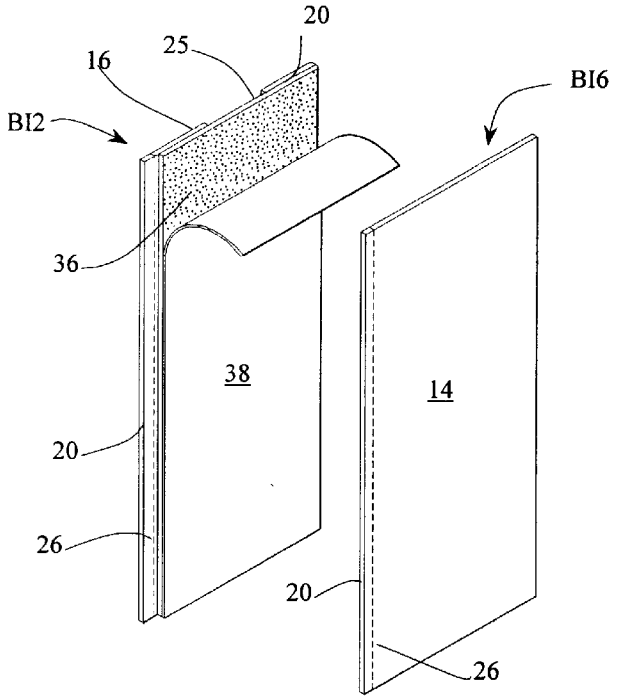

FIGS. 3A and 3B show a binding insert BI2 that does not have a bookmark sheet 14 attached to the blank. In this configuration, the bookmark 14 would have to be installed in the recess 25 between the front panel 16 and rear panel 18 as a second step. As well, the bookmark can be "tipped" or spot glued on to the front panel 16 of pocket 24. The stuffing or tipping of the bookmark 14 into the pocket 24 can be done either manually or with automated equipment. To avoid this additional step, the binding insert BI2 can be accompanied by another binding insert BI6 that would be bound separately. The binding insert BI6 would consist only of a bookmark sheet 14 separated to the binding panel 20 by the binding tear line 28. The advantage of this embodiment is that it allows the binding insert BI2 to be accompanied by a bookmark of different length and material and subsequently higher quality.

Figure 4A:
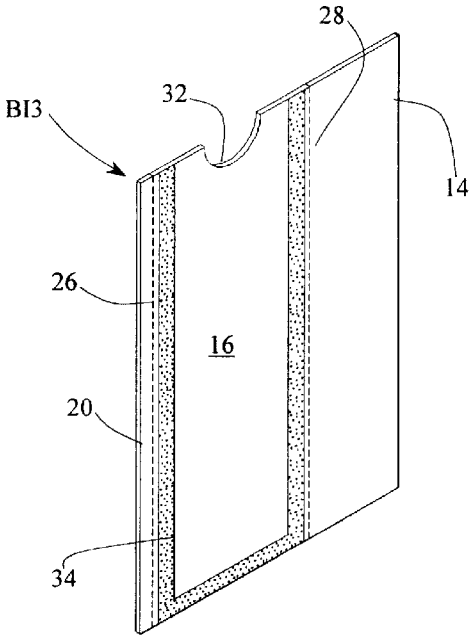
FIGS. 4A and 4B illustrate an insert similar to that of FIGS 1A and 1B, but with no rear panel.
Figure 4B:
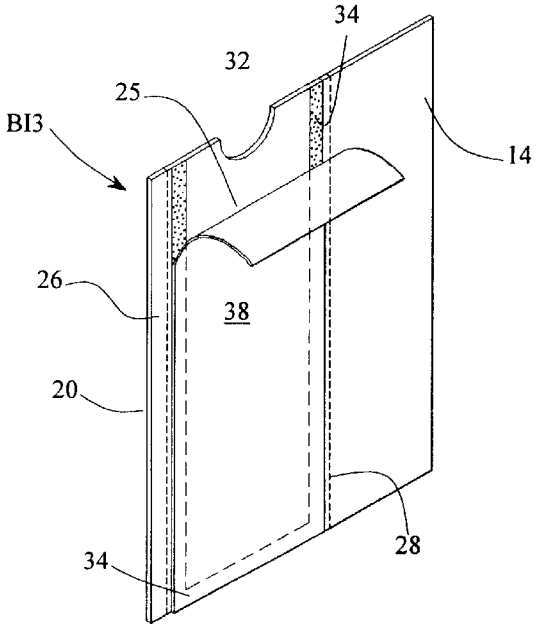

FIGS. 4A and 4B show a binding insert BI3 that has a n attached bookmark sheet 14, but no rear panel. This embodiment utilizes a surface of the book to function as the rear panel 18. Thus the pocket is formed between the front panel 16 and the surface of the book that it is adhered to.

Figure 5:
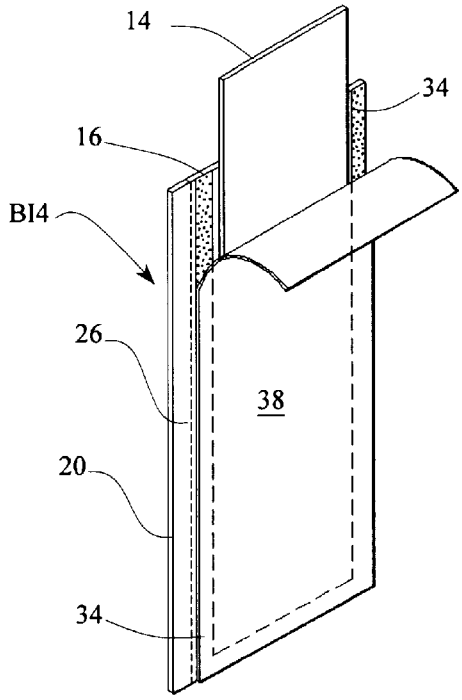
FIG. 5 is a view similar to 4A, but illustrating the bookmark installed between the front panel and the adhesive backing.

FIG. 5 shows a binding insert BI4 that has no bookmark or rear panel. In this embodiment, the backing sheet 38 would be applied to the front adhesive pattern 34. The binding insert BI4 would be attached to the book in the same manner as binding insert BI3. A second step would also be required to tip the bookmark to the front panel, or insert the bookmark between the front panel 16 and the backing sheet 38. Otherwise, it can be accompanied by a binding insert BI6, shown in FIG. 3B.

Figure 6A:
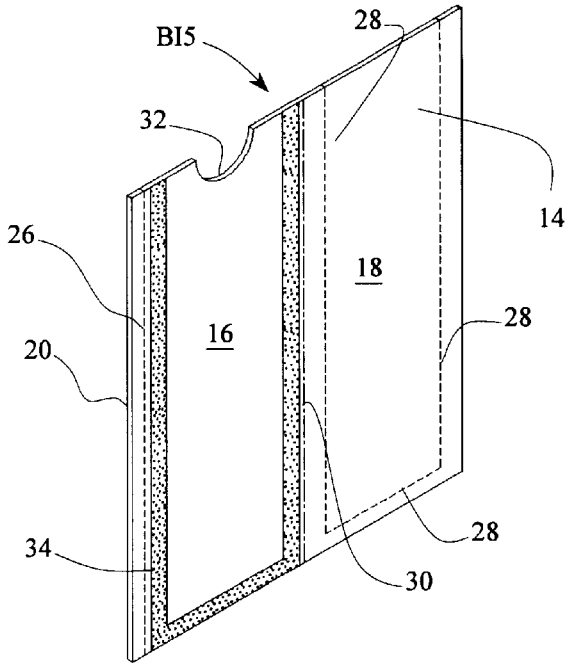
FIGS. 6A and 6B illustrate an insert with the bookmark formed as a perforation in the rear panel.
Figure 6B:
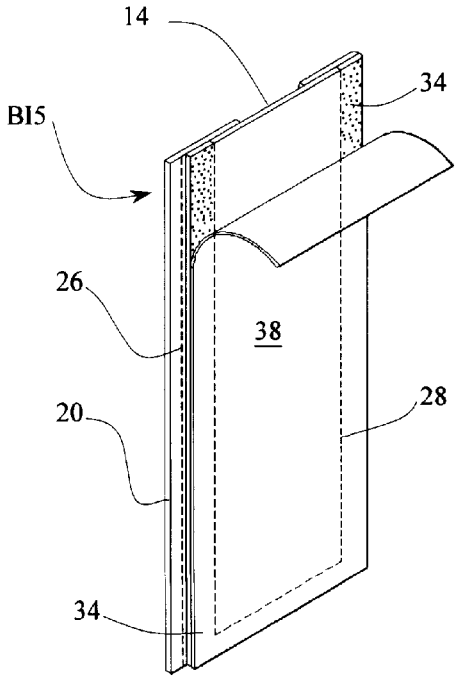
Figure 6C:
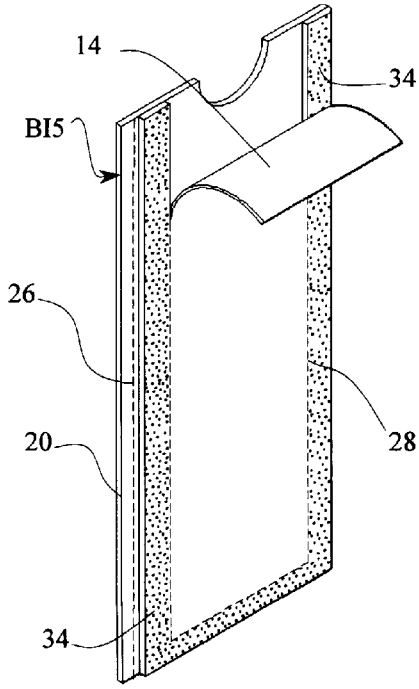
FIG. 6C is a view similar to FIG. 6B, but illustrating the adhesive backing removed and the bookmark partially torn along its perforation.

FIGS. 6A through 6C show a binding insert BI5 that has a perforated bookmark sheet 14 built in to the rear panel 18. This embodiment would have three bookmark perforation lines 28. The bottom of the three perforation lines would preferably be a solid cut to ease removal. As best seen in FIG. 6B, the rear panel 18 would have a "U" shaped adhesive pattern 34 identical to the adhesive pattern on the front panel 16. Once the backing sheet 38 is removed, the bookmark can then be pulled from the pocket via the tear lines 28. The pocket 24 can then be positioned and adhered to the desired surface in the book.

2. Second Main Embodiment: Cover Insert

The second main embodiment can be seen in FIGS. 7 through 12. In this embodiment, and variations thereof, the bookmark and pocket assembly, or cover insert CI, is bound to the cover of the book rather than as an insert or page. The primary difference between the embodiment CI and the embodiment BI lies in the way that the inserts are bound to the cover of the book. Since the binding insert BI is bound as a page, the step of bonding the pocket to the cover is passed off to the consumer. In embodiment CI, this step is done with the production of the book. While the CI embodiment may be more convenient to the consumer, it can be much more expensive to produce. The binding insert BI requires no extra steps in the manufacturing of the book to be implemented. It is simply bound to the spine of the book like all the other pages. The cover insert requires additional equipment to implement. Otherwise, it must be done manually by hand.

Figure 7A:
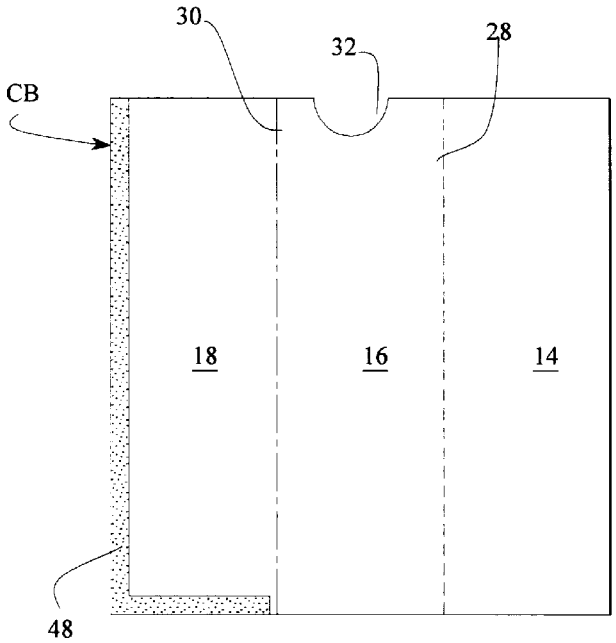
FIG. 7A is a plan view an embodiment that illustrates an insert that is intended to be installed on a cover of a publication.
Figure 7B:
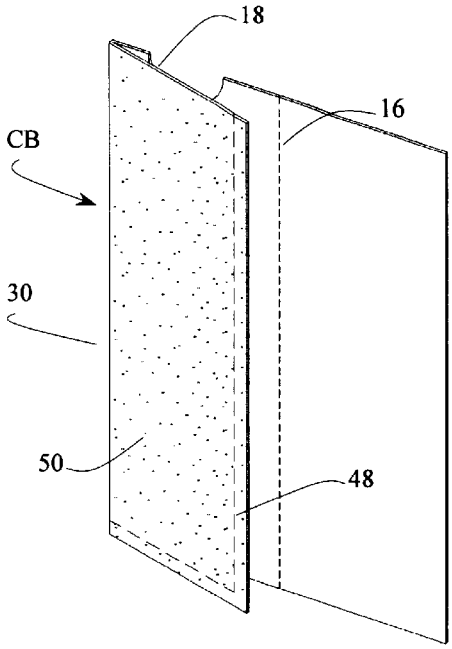
FIG. 7B is a view similar to 7A, illustrating the insert partially folded over.
Figure 7C:
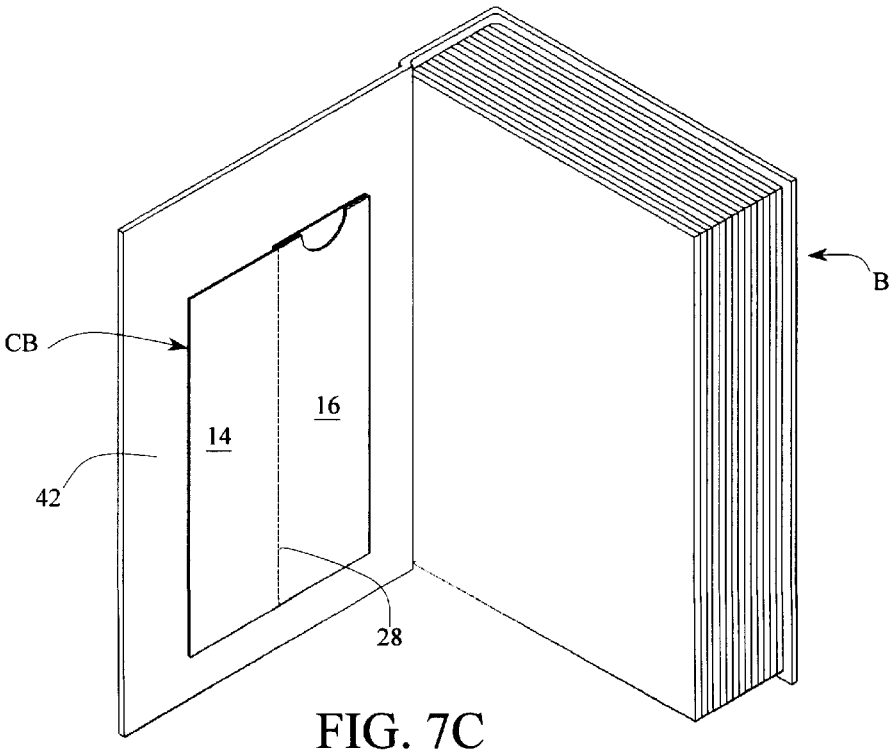
FIG. 7C is a perspective view illustrating the insert mounted to the inside surface of the book cover.

The cover insert CI can be seen in FIGS. 7A and 7B. The cover insert CI consists of the front panel 16, the rear panel 18, and the bookmark sheet 14 that is separated from the front panel 16 by the tear line 28. The rear panel is folded 180 degrees about the fold line 30 on to a modified front adhesive pattern 48 of the front panel 16. The back surface of the rear panel 18 has a modified rear adhesive pattern 50 that consists of a thin coat of pressure or temperature sensitive adhesive, as shown in perspective view in FIG. 7B. FIG. 7C illustrates the folded cover insert CI positioned and adhered to the inside of the front cover 42 of the book B. Once the consumer receives the book in this configuration, the bookmark can be made available by pulling the bookmark sheet 14 along the tear line 28.

In FIG. 7A, the front adhesive pattern 48 is shown as an "L" shape on the rear panel 18 and the bookmark sheet 14 is positioned adjacent to the front panel. However, the invention should not be limited to this configuration. For example, the front adhesive pattern may have a "U" shape, and be positioned on the front panel 16. As well, the bookmark sheet may be located adjacent to the rear panel 18, or adjacent to the front panel 16 and rear panel 18, in which it could form a 2-ply bookmark similar to that seen in FIG. 1C.

Additional embodiments of the cover insert CI are shown FIGS. 8A through FIG. 12.

Figure 8A:
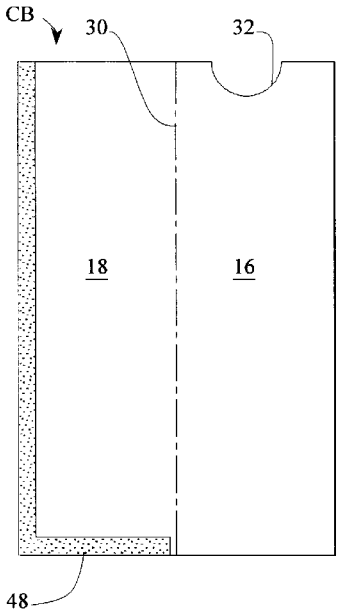
FIG. 8A is an insert similar to that seen in FIG. 7A, but illustrates no bookmark.
Figure 8B:
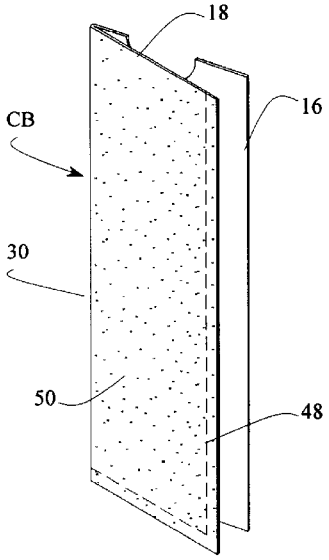
FIG. 8B is a view similar to 8A, illustrating the insert partially folded over.

FIGS. 8A and 8B show a cover insert CI1 that does not have the bookmark sheet 14 as part of the blank. In this configuration, the bookmark 14 would have to be installed between the front panel 16 and rear panel 18 as a second step. The stuffing of the bookmark 14 into the pocket 24 can be done either manually or with automated equipment. To avoid this additional step, the cover insert CI1 can be accompanied by the separate binding insert BI6, shown in FIG. 3B.

Figure 9A:
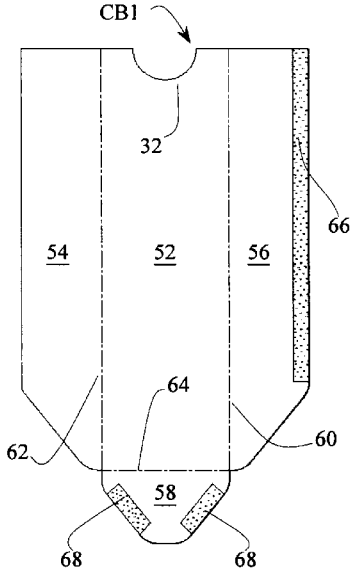
FIG. 9A illustrates an insert similar to that of FIG. 8A, but with three fold lines.
Figure 9B:
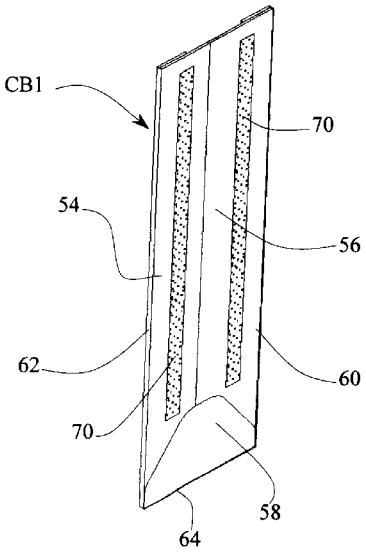
FIG. 9B is a view similar to FIG. 9A, but illustrating the insert in a folded configuration.

FIGS. 9A and 9B show a cover insert CI2 that has three folds instead of one. Cover insert CI2 has a center panel 52, a left flap 54, a right flap 56 and a bottom flap 58, as shown in FIG. 9. The right flap 56 has a flap adhesive pattern 66 and the bottom flap has two bottom adhesive patterns 68. To achieve the configuration illustrated in FIG. 9B, the left flap is fist folded about a left fold line 62 180 degrees to the center panel 52. The right flap 56 is then folded about a right fold line 60 on to the left flap. The pocket is then closed by folding the bottom flap 58 about a bottom fold line 64. As shown in FIG. 9B, the back of the left flap 54 and right flap 56 have rear flap adhesive patterns 70. The rear flap adhesive patterns 70 can then bond the cover insert CI2 to the cover of the book. As in the CI1 embodiment, the bookmark 14 would have to be installed into insert CI2 as a second step, or insert CI2 would need to be accompanied by the binding insert BI6, shown in FIG. 3B.

Figure 10A:
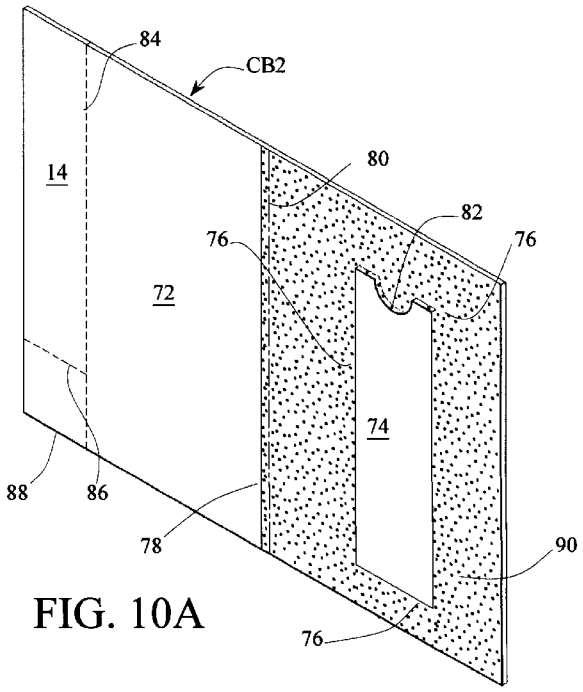
FIG 10A is a front perspective view illustrating an insert that is intended to function as an end-sheet of a book.
Figure 10B:
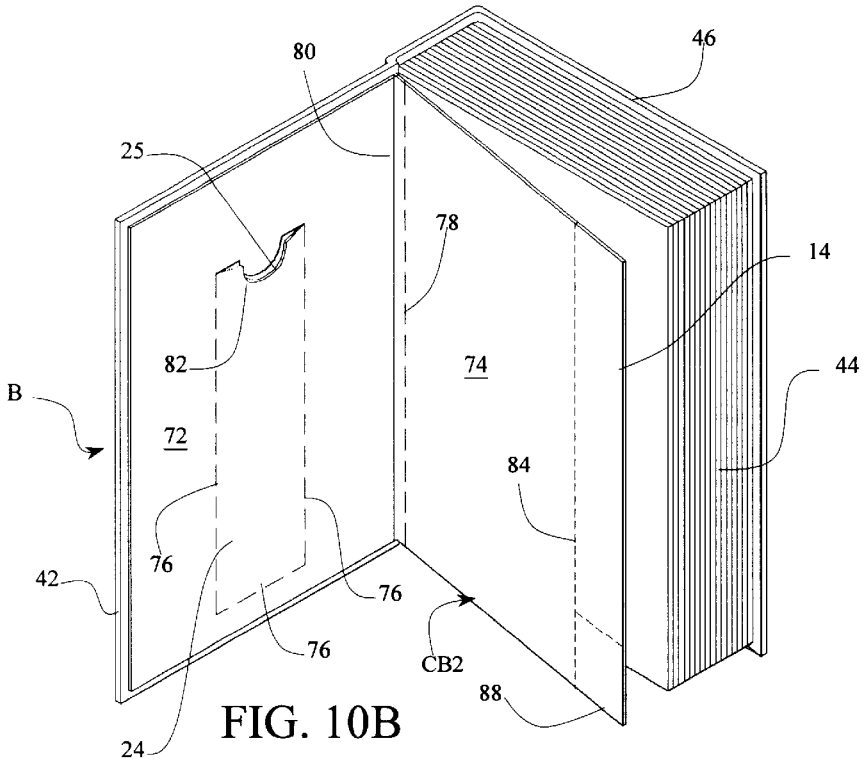
FIG 10B is a front perspective view of a partially opened book illustrating the endsheet blank assembled to the inside surface of a book cover.
Figure 10C:
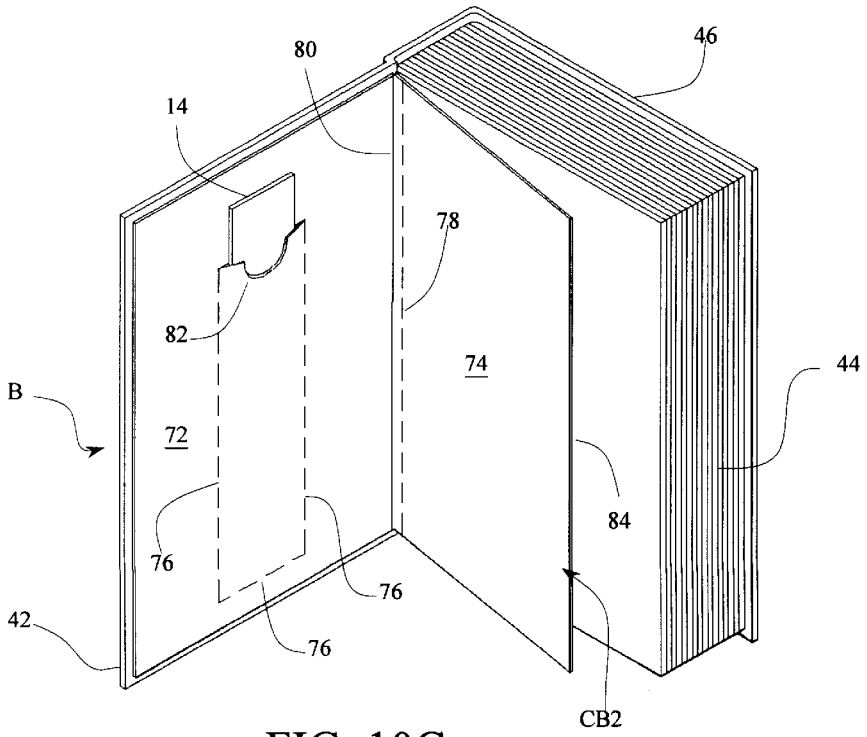
FIG 10C is a view similar to FIG 10A, but illustrating the bookmark being inserted in its stowed position in the pocket.

FIGS. 10A–C show a cover insert CI3 that is intended to be bound as an end-sheet similar to those found in hard or case bound books. As illustrated in FIG. 10A, the cover insert CI3 has a cover adhesive pattern 90 that expands almost the entire surface of the cover panel 74, except for the area bound by a bookmark adhesive boundary 76 and a cut line 82. The adhesive pattern 90 also extends an end-sheet fold line 80 to a small distance on an end-sheet panel 72 where it is bounded by an end-sheet adhesive line 78. Adjacent to the end-sheet panel 72 is the bookmark sheet 14 and a discard panel 88, which are separated from the endsheet panel by a perforation line 84. The discard panel 88 provides a way to shorten the length of the bookmark so that is does not extend beyond the height of the top of the book cover when stowed.

FIG. 10B is a perspective view of book B with the front cover open and shows the cover insert CI3 installed to the inside of the front cover panel 42. In the case-binding assembly process (not shown), the cover insert CI3, or end-sheet, is first folded about the end-sheet fold line 80. It is then bound to the to the block of signatures, or pages 44, on a short strip of adhesive that is between the fold line and the adhesive boundary 78. This is done on both sides of the block of signatures. In the case of the present invention, two cover inserts CI3 may be installed, or one cover insert CI3 in combination with a standard endsheet may be used. The resulting assembly is then trimmed on the three free sides, which creates flush edges along the top, bottom and side of the pages and the cover insert CI3. As seen in FIGS. 10B and 10C, the length and width of the cover insert CI3 when folded about the end-sheet fold line 80 is the same as that of the pages 44. The cover panels 74 are then adhered to the inner surfaces of the front cover panel 42 and rear cover panel 46 of the book to complete the assembly. Once the bookmark is detached from the end-sheet panel 72 about the bookmark tear line 84, it can be inserted in to the opening of the recess 25 provided by the cut line 82 (see FIG. 10C). The discard panel may be torn from the end-sheet panel 72 and then discarded.

Figure 11:
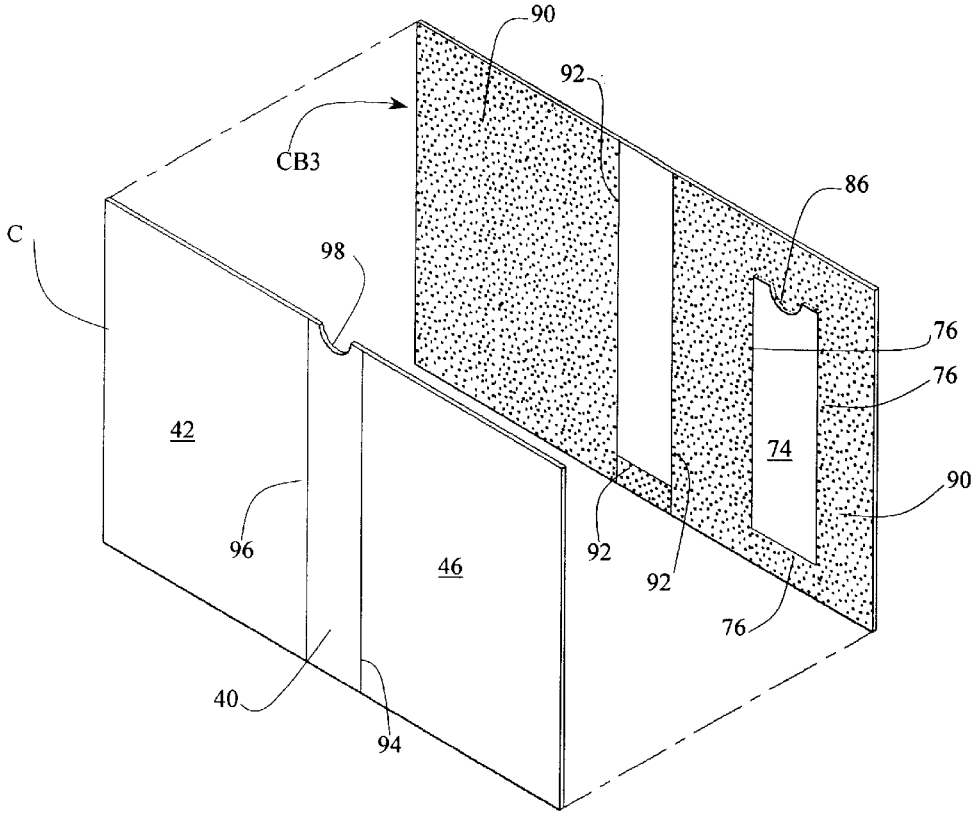
FIG. 11 is an exploded view illustrating an insert and cover before assembly.
Figure 12:
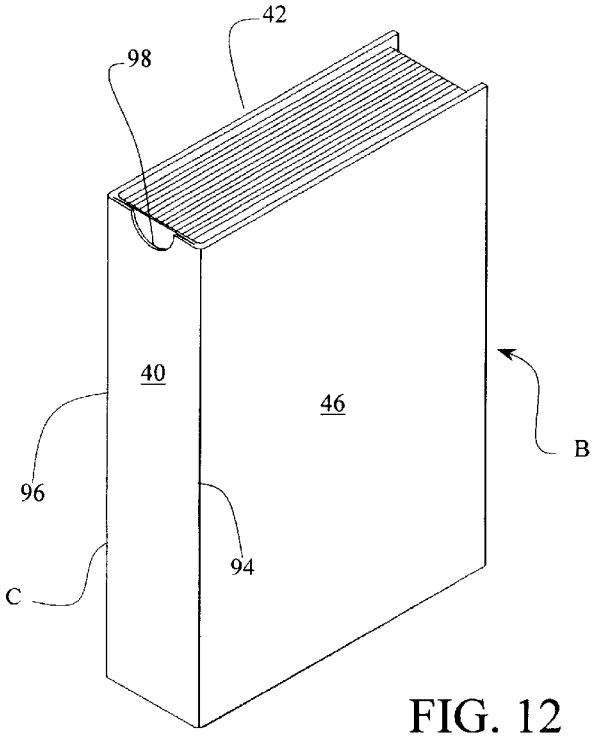
FIG. 12 is a perspective view of a closed book illustrating the cover insert installed with a pocket at the spine.

FIG. 11 illustrates and exploded view of a cover insert CI4 and the cover C of the book. In this embodiment, the cover insert CI4 is adhered to the full length of the inside surface of the cover C. The cover adhesive pattern 90 covers the entire surface of the cover insert CI4, with the exception of the areas bounded by the bookmark adhesive lines 76 and spine adhesive lines 92. A cover C is modified to include a thumb notch 98 at the top of the spine 40. FIG. 12 is a perspective view of book B that has been fitted with the cover insert CI4 and cover assembly. An additional assembly step is required to install the bookmark 14 at either the inside pocket (see FIG. 10C), or from the pocket located at the thumb notch 98 of the spine 40.

Accordingly, the person skilled in the art will understand that the bookmark and pocket assembly of the present invention will provide the book user with a convenient and readily available method for marking pages. In addition, a new and efficient type of advertising will be available for companies and businesses looking to get their message across to the consumer. The bookmark and pocket assembly of the present invention utilizes manufacturing techniques currently found in envelope and box production, as well assembly processes that are currently used in the book binding industry. Therefore, the cost and production time for the bookmark and pocket assembly is minimal. The bookmark and pocket assembly also provides a bookmark that can be detached from the publication. Thus, if the user finds the bookmark undesirable, it can easily be removed and replaced accordingly. As well, it provides an inconspicuous and convenient pocket that is out of the way from distracting the reader. Finally, it provides a safe means of storage for the bookmark while the book is being used or stored away.

Although the description above contains many specifications, these should not be construed as limiting the scope of the invention, but as merely providing illustrations of some of the presently preferred embodiments of the invention. For example, the bookmark and pocket assembly is not limited to being produced only with the book. All of the binding inserts, BI1–5 and the first three cover inserts, CI1–3, can be easily modified to become stand-alone units that are sold without books. This would allow the consumer to purchase the bookmark and pocket assembly and install them to books that are not already furnished with them. The adhesive pattern 34 can also be adapted so that recess 25 of the pocket 24 would be side loading instead of top loading. The bookmark or pocket can be of various materials, such as cover stock, card stock, cardboard, plastic, polyethylene, vinyl, nylon, rubber, leather, various impregnated or laminated fibrous materials, etc. The bookmark can also have other sizes or shapes, such as circular, oval, trapezoidal, figurine, etc.

Thus the scope of the invention should be determined by the appended claims and their legal equivalents, rather than by the examples given.

I claim:

1. A bookmark and pocket assembly for a book or other bound publication, the assembly comprising:

a) a generally planar sheet having a thickness, a length, and a width, the thickness being less than the width, and the width being approximately one-third the length;

b) a pocket, having an opening at one end and a recess for releasbly receiving said sheet, said pocket having means for releasbly securing said sheet thereby allowing said sheet to be slidably inserted into and extracted from said recess; and c) whereby said recess is entirely self enclosed from material of said pocket; and d) means for securely attaching said pocket to a surface of said book.

2. The assembly of claim 1 wherein:

a) said assembly being generally rectangular in shape including said sheet detachably joined to said pocket by a bookmark tear line, and said sheet detachably joined to a binding panel by a binding tear line;

b) said sheet having an area defined for an advertisement or aesthetic design;

c) said pocket having a front panel foldably joined to a rear panel of generally the same size, said front panel having an adhesive pattern so that when said rear panel is folded on to said front panel, said recess is formed in generally the same shape and size of said sheet;

d) said front panel having a thumb notch at the top thereof to allow said sheet to be removed from said pocket by thumb;

e) said rear panel having a rear adhesive pattern on a back surface for attachment means to said book surface, and a backing sheet covering said adhesive over its extremities;

f) said binding panel having interface means for binding said assembly as an insert to a spine of said book, where said book will then be shipped for resale; and g) whereby the insert is detachable from said book by pulling it along said binding tear line, detaching said sheet from said pocket by pulling along said bookmark tear line, removing said backing sheet from said adhesive, affixing rear surface of said pocket to said surface on book, and inserting said sheet in said recess of said pocket.

3. The assembly of claim 2 wherein said rear panel is elongated to extend contiguous to said binding tear line when folded over, and said sheet has said adhesive such that when said rear panel is folded over said sheet forms a 2-ply lamination.

4. The assembly of claim 2 wherein a moisture sensitive adhesive is used on the back surface of the rear panel instead of said adhesive and backing sheet, whereby a consumer moistens thereof and affixes it to said book surface.

5. The assembly of claim 2 wherein said front panel is detachably joined to said binding panel, and a bookmark of heavier stock is installed into said recess of said pocket.

6. The assembly of claim 5 wherein said sheet is spot glued to said front panel of said pocket.

7. The assembly of claim 5 wherein said sheet is detachably joined to a binding panel and accompanies pocket as a separate bound insert.

8. The assembly of claim 5 wherein said sheet is made of glossy cover stock.

9. The assembly of claim 5 wherein said sheet is detachably joined to said front panel from side opposite said binding panel, and said backing sheet is applied to said adhesive pattern of said front panel.

10. The assembly of claim 2 wherein said insert comprises of said front panel foldably joined between said rear panel and detachably joined between said sheet, whereby said back surface of said insert is a fixed to said surface of said book.

11. The assembly of claim 10 wherein said insert is sold independently for installation by said consumer.

12. The assembly of claim 10 wherein a sheet of heavier stock is installed into said recess of said pocket.

13. The assembly of claim 10 wherein said sheet comprises of plastic.

14. The assembly of claim 1 wherein the insert comprises:

a) a center panel with said thumb notch foldably joined by a right flap, a left flap, and a bottom flap;

b) said right flap containing a flap adhesive pattern, and said bottom flap containing two bottom flap adhesive patterns;

c) said left flap is folded onto said center panel, said right flap is folded onto said left flap, and said bottom flap is folded over to complete pocket;

d) said center panel has a rear surface that is covered with said adhesive; and e) whereby said bookmark is installed into a recess of said pocket before said pocket is affixed to said book.

15. A bookmark and pocket assembly, comprising:

a) a cover panel foldably joined to an end-sheet panel, said end-sheet panel detachably joined to said sheet and a discard panel;

b) said cover panel having an adhesive pattern covering entire surface of said cover panel except for a recess area having a cut line defining its upper extremity;

c) said adhesive pattern extending a small distance on to said end-sheet panel; and d) whereby said cover panel is adhered to the inner front surface of a cover of said book, and a small portion of the end sheet panel is adhered to an end-sheet of said book; and e) whereby said sheet is detachable from said end-sheet and insertable into said recess through an opening created by said cut line.

16. The assembly of claim 15 wherein the insert comprises:

a) said adhesive pattern covering entire surface of said insert except for said recess and a spine recess;

b) said cover having a notch at the top edge of said spine; and c) whereby said insert is adhered to entire inside surface of said cover of said book, and said recess is formed at said spine and said front panel of said cover.

17. A method for releasbly securing a bookmark to a book, comprising:

a) providing a pocket from a planar sheet of material with a recess contained by three sides and an opening at one end;

b) providing a planer sheet of material as a bookmark for marking a page in a book;

c) attaching said pocket securely to a surface in said book; and d) whereby said pocket provides means for said bookmark to be repeatedly inserted and extracted from said pocket.

18. A method of constructing the assembly of claim 17 comprising:

a) providing a planar sheet of foldable paperboard material, said sheet detachably joined at one side by a bookmark tear line to a pocket having a front panel and a rear panel, said sheet being detachably joined at the other side to a binding panel by a binding tear line;

b) printing an advertisement on said sheet;

c) cutting said sheet to a rectangular shape with a thumb notch at the top of said front panel;

d) perforating said binding and bookmark tear lines and scoring said front panel from said rear panel;

e) applying an adhesive pattern comprising of a thin strip of adhesive around the bottom and sides of said front panel;

f) folding over said rear panel on to said adhesive pattern of said front panel causing the front and rear panels to be adhered together and forming a recess between them;

g) applying an adhesive and a backing sheet to back surface of rear panel;

h) binding said binding panel to a spine of a book as a page in said book.

19. A method according to claim 18 wherein a consumer removes said sheet from said book by pulling along said binding tear line, detaches said pocket from said sheet by pulling along said bookmark, removes said backing sheet from said adhesive, affixes said rear surface of said pocket to a surface on said book, and inserts said sheet in said recess of said pocket.

* * * * *